United States Patent [19]

Altman et al.

[11] Patent Number: 4,520,351

[45] Date of Patent: May 28, 1985

[54] PASSIVE PERSONAL ALARM DEVICE

[76] Inventors: Sidney Altman, 71 Blake Rd., Hamden, Conn. 06517; Dan Kasha, 84 Bayard Ave., North Haven, Conn. 06473

[21] Appl. No.: 356,044

[22] Filed: Mar. 8, 1982

[51] Int. Cl.[3] ..... G08B 21/00

[52] U.S. Cl. ..... 340/574; 340/309.15; 340/530

[58] Field of Search ..... 340/574, 546, 530, 571, 340/529, 309.15, 309.6; 116/DIG. 44

[56] References Cited

U.S. PATENT DOCUMENTS

| | | | |
|---|---|---|---|
| 2,766,358 | 10/1956 | Davidson | 340/574 |
| 3,579,222 | 5/1971 | Freeman | 340/541 |
| 3,720,937 | 3/1973 | Lang et al. | 340/546 |
| 3,832,705 | 8/1974 | King et al. | 340/571 |
| 3,866,204 | 2/1975 | Barkley | 340/530 |
| 4,258,359 | 3/1981 | McLamb | 340/546 |
| 4,262,285 | 4/1981 | Polley | 340/574 |
| 4,264,892 | 4/1981 | Zonn | 340/521 |
| 4,404,549 | 9/1983 | Berg | 340/574 |

FOREIGN PATENT DOCUMENTS

| | | | |
|---|---|---|---|
| 2042230 | 9/1980 | United Kingdom | 340/574 |

*Primary Examiner*—Glen R. Swann, III
*Attorney, Agent, or Firm*—Paul J. Lerner

[57] ABSTRACT

A passive personal alarm device is activated by release of a spring-loaded button switch which, when held down, opens an otherwise closed circuit. A time delay element in the circuit prevents sounding of the alarm for a predetermined period in the event of an accidental release of the actuating button. The button is released, either purposefully or inadvertently, during an attack and the alarm is sounded after expiration of the time delay. Once activated, the alarm device can be deactivated only by repositioning a number of coded switches in a pattern known only to the alarm user.

12 Claims, 4 Drawing Figures

PASSIVE PERSONAL ALARM DEVICE

BACKGROUND AND SUMMARY OF THE INVENTION

The present invention relates to alarm devices and, more particularly, to a passive, personal alarm device.

Personal safety in urban areas is of increasing concern to the populace. This is especially true of individuals, particularly women, who must walk through isolated areas at night or other times of day when few people are in the vicinity. Such situations arise, for example, when nurses or other night-shift workers walk to parking lots after work or on weekends. If such people are assaulted, particularly with intent to rape, a method is needed of alerting the surrounding neighborhood, or a central security station, and/or temporarily distracting the attacker to facilitate escape.

Several security equipment manufacturers, both in this country and abroad, have produced hand-held, personal devices intended either to incapacitate an attacker through the use of an agent such as tear gas, or to alert the neighborhood with a very loud noise. These devices all require the user to take some action to activate the same when attacked. Unfortunately, that is frequently impossible, either because of physical incapacitation or because of inaction due to a temporary state of shock during the initial moments of the attack. Furthermore, experience has shown that these devices seldom are used effectively enough to deter an attacker. Also, an attacker has the opportunity to deactivate devices of this type.

Property-protecting portable alarm devices with passive switches have also been described. These devices, which contain various complex switching mechanisms, must generally be fixed in a particular place or orientation to be maintained in the active mode. They can be quickly deactivated by an attacker and do not have the capability of remaining silent during false alarm situations or during a momentary, inadvertant actuation.

It is, therefore, a primary object of the present invention to provide a personal alarm device that will be activated during an attack without the need for positive action by the user.

It is another object to provide an alarm device of the aforementioned type, where the user can correct for accidental release of the activating switch so as to prevent activation of the alarm system.

It is yet another object to provide an alarm device of the type above-described, which is resistant to deactivation by an attacker.

The above, and other objects as may hereinafter appear, are achieved by an alarm device activated by release of a spring-loaded button switch which, when held down, opens an otherwise closed circuit. A time delay element in the circuit prevents sounding of the alarm for a predetermined period in the event of an accidental release of the actuating button. The button is released, either purposefully or inadvertantly, during an attack and the alarm is sounded after expiration of the time delay. Once activated, the alarm device can be deactivated only by repositioning a number of coded switches in a pattern known only to the alarm user.

DESCRIPTION OF THE PREFERRED EMBODIMENT

The personal alarm device of the present invention comprises a housing having, disposed therein, a warning device T1 and a battery B1,B2 connected in series with a first switch S6 which is of the spring-loaded type and biased toward the closed position. A switch assembly 3, having a single open position and a number of closed positions, is connected in series in the circuit above-described.

Figure 1:
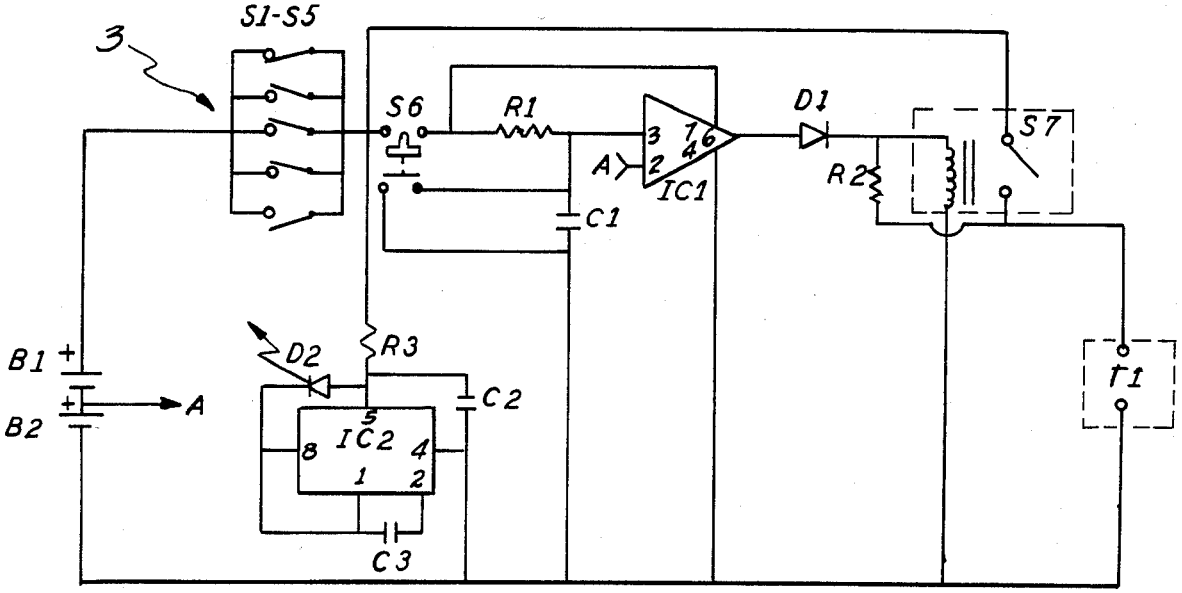
FIG. 1 is an electrical circuit diagram of an alarm device arranged in accord with the present invention.
Figure 2:
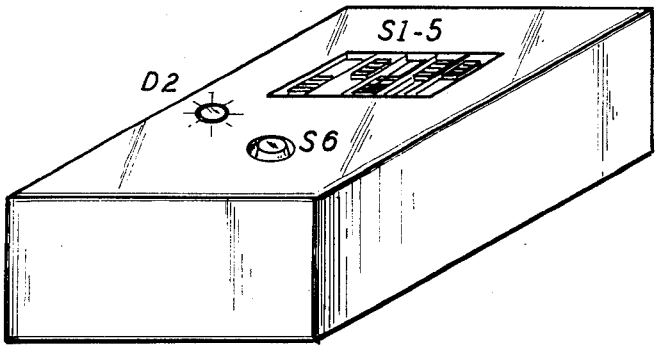
FIG. 2 is a perspective view showing the top of the alarm device of FIG. 1.
Figure 3:
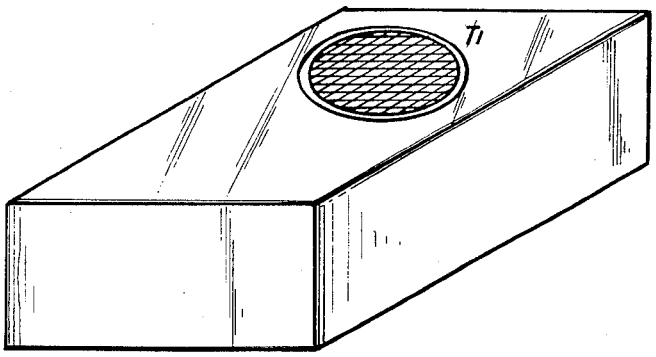
FIG. 3 is a perspective view showing the bottom of the alarm device of FIG. 1.
Figure 4:
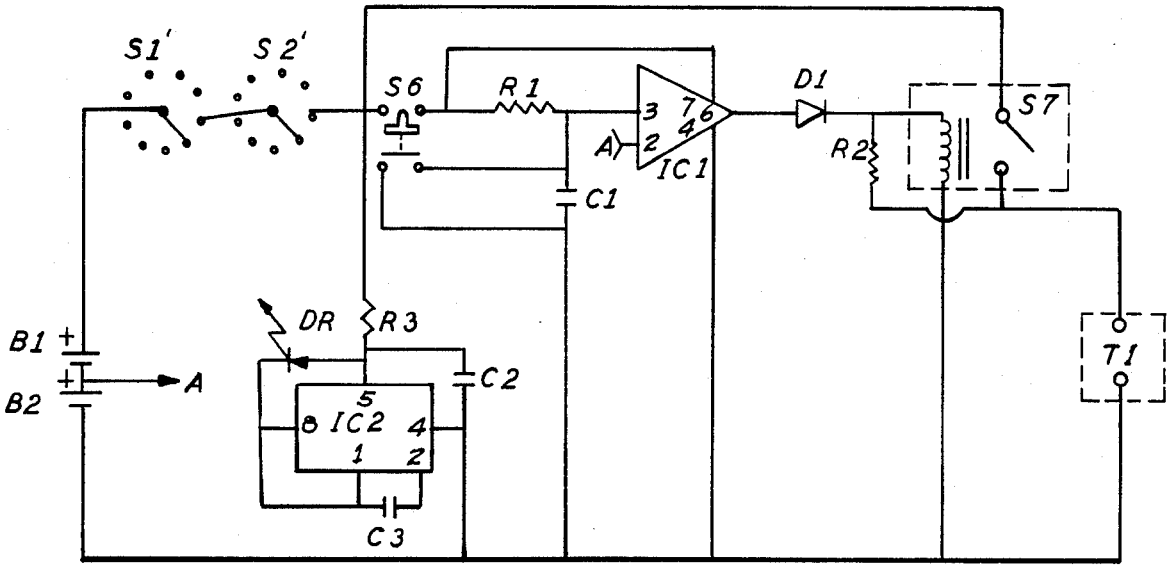
FIG. 4 is an electrical circuit diagram showing the alarm of FIG. 1 with dial switches in place of binary switches.

As shown in FIG. 1, switch assembly 3 may advantageously comprise a number (5 are illustrated) of single pole, single throw (binary) switches, S1–S5, connected in parallel, such that only one setting of all of the switches S1–S5 deactivates the circuit (in the embodiment shown, 32 settings are possible, of which only 1 will deactivate the circuit). The particular setting of the switches S1–S5 which constitutes the open setting is indistinguishable from the closed settings by mere external examination and is known only by the user. This aspect of the invention is in recognition of the possibility that an attacker may attempt to deactivate an alarm once sounded. Alternatively, the binary switches S1–S5 may be replaced by 2 dial switches, each of which has 9 settings.

It will be appreciated that, even with the switch assembly 3 in one of the closed settings, the circuit will remain open so long as the first switch S6 is maintained in a depressed (open) position as shown in FIG. 1. Thus, the alarm user depresses the first switch S6 before activating the circuit by placing the switch assembly 3 in a closed setting. With the circuit thus activated, the user, maintaining the first switch S6 in the depressed (open) position, may proceed to walk home, etc. If release of the first switch S6 now occurs, for any reason, the circuit is closed (after the expiration of a time delay interval, as will be more fully described hereinafter) and the warning device T is activated, sounding the alarm.

Means, comprising a relay S7, connected to bypass the first switch S6, are provided to prevent deactivation of the warning device T, subsequent to activation thereof, by redepression of the first switch S6. The relay S7, which is normally open, closes during actuation of the warning device T, bypassing the first switch S6. At this point, the warning device T may be deactivated only by placing the switch assembly 3 in the single open setting.

Means, comprising a capacitor C1 and a resistor R1 (RC network), connected in series with the first switch S6, are provided to create a predetermined time delay between the release of the first switch S6 and the closing of relay S7 and activation of the warning device T. Thus, should the user accidentally remove a finger from the first switch S6, or wish to transfer the alarm device to the other hand, or drop the device, the time delay means prevents a false alarm. The length of the interval is determined by the characteristics of the capacitor C1 and the resistor R1 and is preferably about 3 seconds.

Means, comprising a light-emitting diode (LED) D2, connected in parallel with the warning device T, are provided to indicate that the battery B is charged and that the second switch 3 is in a closed setting. The light-emitting diode D2 is controlled by an LED flasher 1C2 and flashes continuously when the second switch 3 is closed. The time constant of the flashing is determined by a capacitor C3, while a second capacitor C2 and a resistor R3 are provided to maintain proper working conditions for the LED flasher 1C2.

The warning device T may advantageously comprise a pair of buzzers of different frequencies emitting a sound pressure level of 110 db at a frequency of 2700 Hz. A battery consisting of 2 9-volt cells will power such buzzers for at least 10 minutes. Alternatively, the warning device may comprise a voice synthesizer adapted to mimic a scream for help, a police siren, or a single frequency radio transmitter. The use of radio transmitters may be enhanced by assigning specific frequencies to different users or for use in particular locations. This system can, of course, be elaborated upon to include more sophisticated location signaling devices.

It is to be noted that the use of a spring-loaded switch S6 and the time delay means maximizes the surprise to an attacker, who will, hopefully, be startled by the apparent temporal and possibly spatial separation between the victim and the activated alarm device which may have been dropped or thrown in the course of an assault. A few seconds of inaction on the part of the attacker, resulting from confusion as to the source of the alarm, may afford the victim the opportunity to escape.

The housing 1 is formed of an impact resistant material, such as polycarbonate, with the first switch S6 and the switch assembly 3, the warning device T and the LED operational indicator D2 being recessed or mounted flush with the housing surface. The alarm device, including batteries, can be packaged in a housing approximately 5 inches by 2 inches by 2 inches.

It should be readily apparent that various changes in components, and in the arrangement thereof, may be made to the above-described embodiment without departing from the spirit and contemplation of the present invention which is intended to be limited in scope only by the appended claims.

We claim:

1. A personal alarm device of the type comprising:

a. a housing;

b. a warning device and a battery both disposed in said housing; and c. first switch means nonremovably connected to said housing and biased toward a closed setting;

d. said warning device, said battery and said first switch means being connected in series; the improvement comprising: second switch means, connected in series in said first circuit, having a plurality of settings of which a relatively small number are open settings and the remainder are closed settings, the ones of said open settings being indistinguishable from the ones of said closed settings by mere external examination of said alarm device.

2. The alarm device of claim 1, further comprising means operable to prevent deactivation of said warning device, subsequent to activation thereof, by manipulation of said first switch means.

3. The alarm device of claim 2, wherein said second switch means comprises a plurality of single pole single throw (binary) switches, arranged in parallel, whereby said second switch means is in a closed setting unless each of said binary switches is in an open setting.

4. The alarm device of claim 2, wherein said second switch means comprises a plurality of dial switches, arranged in parallel, whereby said second switch means is in a closed setting unless each of said dial switches is in an open setting.

5. The alarm device of claim 4, wherein said deactivation prevention means comprises a relay connected to bypass said first switch means, said relay, normally in an open condition, being closed by the closing of said first switch means.

6. The alarm device of claim 1, further comprising means for indicating that said battery means is charged and that said second switch means is in one of said closed settings.

7. The alarm device of claim 6, wherein said indicator means comprises a light emitting device connected in parallel with said warning device.

8. The alarm device of claim 1, wherein said warning device comprises means for generating an audible signal.

9. The alarm device of claim 1, wherein said warning device comprises a radio transmitter adapted to broadcast a signal of a predetermined frequency.

10. A personal alarm device comprising:

a. a housing;

b. a warning device and a battery both disposed in said housing;

c. first switch means biased toward a closed setting;

d. second switch means having a plurality of settings of which a relatively small number are open settings and the remainder are closed settings, the ones of said open settings being indistinguishable from the ones of said closed settings by mere external examination of the alarm device; said warning device, said battery and said first and second switch means being connected in series;

e. means operable to prevent deactivation of said warning device, subsequent to activation thereof, by manipulation of said first switch means; and f. means for providing a predetermined time delay between the closing of said first switch means and the activation of said deactivation prevention means.

11. The alarm device of claim 10, wherein said time delay means comprises a capacitor, and a resistor, connected in series with said first switch means and said battery.

12. A personal alarm device comprising:

a. a housing, formed of an impact resistant material;

b. a warning device and a battery both disposed in said housing;

c. first switch means nonremovably connected to said housing and biased toward a closed setting;

d. second switch means having a plurality of settings of which a relatively small number are open settings and the remainder are closed settings, the ones of said open settings being indistinguishable from the ones of said closed settings by mere external examination of the alarm device, said warning device, said battery, and said first and second switch means being connected in series; said first and second switch means and said warning device being disposed so as not to project beyond the immediately adjacent surface of said housing, whereby they are protected from injury.

* * * * *